US007715770B2

(12) United States Patent
Kinoshita

(10) Patent No.: US 7,715,770 B2
(45) Date of Patent: May 11, 2010

(54) IMAGE FORMING APPARATUS WITH ACCURATE CORRECTION OF COLOR MISALIGNMENT

(75) Inventor: Izumi Kinoshita, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 150 days.

(21) Appl. No.: 12/007,702

(22) Filed: Jan. 15, 2008

(65) Prior Publication Data

US 2008/0181634 A1 Jul. 31, 2008

(30) Foreign Application Priority Data

Jan. 25, 2007 (JP) ..... 2007-014869

(51) Int. Cl.
*G03G 15/01* (2006.01)

(52) U.S. Cl. ..... 399/301; 347/116; 399/49; 399/51

(58) Field of Classification Search ..... 399/301, 399/394, 395, 396, 49, 51; 347/117; 358/406, 358/504

See application file for complete search history.

(56) References Cited

U.S. PATENT DOCUMENTS 4,950,905 A * 8/1990 Butler et al. ..... 250/358.1
5,139,339 A * 8/1992 Courtney et al. ..... 356/446
6,128,459 A * 10/2000 Iwata et al. ..... 399/301
6,218,660 B1 * 4/2001 Hada ..... 347/116 X
6,295,435 B1 * 9/2001 Shinohara et al. ..... 399/301
6,704,350 B1 3/2004 Ryu et al.
7,139,518 B2 * 11/2006 Masubuchi ..... 399/301
2004/0114679 A1 6/2004 Ryu et al.
2007/0048031 A1 3/2007 Kinoshita

FOREIGN PATENT DOCUMENTS

JP 11-065208 3/1999
JP 2002-236402 8/2002
JP 2002-244393 8/2002
JP 3591144 11/2004
JP 2005-031227 2/2005

* cited by examiner

*Primary Examiner*—Sophia S Chen
(74) *Attorney, Agent, or Firm*—IPUSA, PLLC

(57) ABSTRACT

An image forming apparatus includes a detection unit configured to cause a light emitting device to emit light, to cause a light receiving device to receive the light reflected by an object, and to produce a detection signal having a varying signal level responsive to an intensity of the received reflected light, a color misalignment correction unit configured to correct color misalignment resulting from positional misalignment between the developer images of respective colors on a transfer body by controlling an exposure unit in response to detected data indicative of the developer images detected in the detection signal, and an adjustment unit configured to identify a plurality of peak positions in the detection signal detected with respect to a single developer image and to adjust the detected data indicative of the developer images detected in the detection signal in response to difference in the peak positions.

14 Claims, 9 Drawing Sheets

IMAGE FORMING APPARATUS WITH ACCURATE CORRECTION OF COLOR MISALIGNMENT

BACKGROUND OF THE INVENTION

1. Field of the Invention

The disclosures herein generally relate to methods and apparatuses for forming images by use of electrostatic printing, and particularly relates to a method and apparatus for forming images in which color misalignment resulting from the positional misalignment of plural color developers disposed on a transfer body is corrected.

2. Description of the Related Art

Among various types of image forming apparatuses such as color copier machines and color laser printers, a tandem-type image forming apparatus transfers toner images corresponding to four developer colors, i.e., yellow., cyan, magenta, and black, successively onto a transfer body (e.g., transfer belt or transfer paper sheet). With such configuration, tandem-type image forming apparatuses tend to have a risk of developing color misalignment resulting from the mutual positional misalignment of toner images corresponding to respective colors. Such color misalignment greatly affects the quality of color images generated by fusing the toner images of respective colors onto a transfer paper sheet. It is thus a technical challenge to reduce color misalignment in such a type of image forming apparatus.

Japanese Patent Application Publication No. 2005-31227 (hereinafter referred to as Patent Document 1) discloses a positional misalignment correcting apparatus which optically detects a color-misalignment correction pattern comprised of several patches. The patches are formed on an intermediate transfer body by superimposing a reference color pattern and color patterns for correction (correction-purpose toner images) to correct the positional misalignment of each color based on the detected results. This position correcting apparatus includes a detecting means for detecting a specular reflection component and diffuse reflection component upon optically reading the misalignment correction pattern by use of a reflective-type photo sensor. The position correcting apparatus also includes a correction means for correcting positional misalignment based on the detected specular reflection component and diffuse reflection component. A glossiness of the intermediate transfer body is determined based on the specular reflection component detected upon optically reading the misalignment correction pattern by use of the reflective-type photo sensor. A luminance is determined based on the detected diffuse reflection component.

Japanese Patent Application Publication No. 2002-236402 (hereinafter referred to as Patent Document 2) discloses an image forming method that forms color toner reference images (i.e., correction-purpose toner images) on an image carrying member or transfer-object carrying member. The image forming method also detects reflective light from the reference images by use of both a diffuse-reflection-type detector and a specular-reflection-type detector. The image forming method then corrects the output value of the diffuse-reflection-type detector based on the output value of the specular-reflection-type detector and the output value of the diffuse-reflection-type detector.

In the technologies disclosed in Patent Document 1 and Patent Document 2, a correction-purpose toner image is detected by use of a light emission device and a detector that is provided with a light receiving device for receiving a specular reflection component and a light receiving device for receiving a diffuse reflection component. If a detector provided with a single light receiving device were able to be used, however, a cost reduction and size reduction of the detector could be achieved by detecting the correction-purpose toner image using the specular reflection component received by the single light receiving device.

If the above-noted detector is placed such that the optical axis of the light emitting device and the optical axis of the light receiving device cross each other on the surface of a transfer body within a plane parallel to the normal line of the transfer body, the reflective light received by the light receiving device will mostly be a specular reflection component, thereby being able to disregard the effect of a diffuse light component. If the optical axis of the light emitting device and the optical axis of the light receiving device are misaligned due to manufacturing variation of the detector, however, the effect of a diffuse reflection component contained in the reflective light received by the light receiving device cannot be disregarded, thereby degrading the detection accuracy of the detector.

What is needed is an image forming method and image forming apparatus that is implemented by use of an inexpensive configuration, yet can accurately detect a correction-purpose toner image.

SUMMARY OF THE INVENTION

It is a general object of at least one embodiment of the present invention to provide an image forming apparatus that substantially eliminates one or more problems caused by the limitations and disadvantages of the related art.

In one embodiment, an image forming apparatus includes a plurality of image carrying members arranged in line along a travel direction of a transfer body, an exposure unit configured to expose to light the image carrying members that are electrically charged so as to form electrostatic latent images, a plurality of developing units configured to develop the electrostatic latent images by use of developers corresponding to respective colors for the respective image carrying members, a carrying unit configured to carry the transfer body, a transfer unit configured to transfer the developers of the respective colors from the image carrying members to the transfer body to form developer images on the transfer body, a detection unit including a light emitting device and a light receiving device and configured to cause the light emitting device to emit light, to cause the light receiving device to receive the light reflected by an object, and to produce a detection signal having a varying signal level responsive to an intensity of the received reflected light, thereby detecting the developer images of respective colors formed on the transfer body by the exposure unit, the developing units, and the transfer unit, a color misalignment correction unit configured to correct color misalignment resulting from positional misalignment between the developer images of respective colors transferred onto the transfer body by controlling the exposure unit in response to detected data indicative of the developer images detected in the detection signal produced by the detection unit, and an adjustment unit configured to identify a plurality of peak positions in the detection signal detected with respect to a single developer image and to adjust the detected data indicative of the developer images detected in the detection signal in response to difference in the peak positions.

In one embodiment, an image forming apparatus includes a plurality of image carrying members arranged in line along a travel direction of a transfer body, an exposure unit configured to expose to light the image carrying members that are electrically charged in order to form electrostatic latent images, a plurality of developing units configured to develop the electrostatic latent images by use of developers corresponding to respective colors for the respective image carrying members, a carrying unit configured to carry the transfer body, a transfer unit configured to transfer the developers of the respective colors from the image carrying members to the transfer body to form developer images on the transfer body, a detection unit including a light emitting device and a light receiving device and configured to cause the light emitting device to emit light, to cause the light receiving device to receive the light reflected by an object, and to produce a detection signal having a varying signal level responsive to an intensity of the received reflected light, thereby detecting the developer images of respective colors formed on the transfer body by the exposure unit, the developing units, and the transfer unit, and an adjustment unit configured to identify a first peak of the detection signal positioned in a first area of the detection signal situated on one side of a reference level that is a signal level of the detection signal observed when no developer image is detected, to identify a second peak and third peak of the detection signal that are positioned before and after the first peak on a time axis and that are positioned in a second area of the detection signal situated on an opposite side of the reference level, and to adjust the detected data indicative of the developer images detected in the detection signal in response to a difference between a first distance from the first peak to the second peak and a second distance from the first peak to the third peak.

According to at least one embodiment of the present invention, an inexpensive configuration using only one light receiving device in the detection unit can accurately detect developer images.

According to at least one embodiment of the present invention, a correspondence table that lists the values of difference in the peak positions and adjustment amounts of detected data paired in one-to-one correspondence with each other is prepared in advance, and is referred to in order to adjust the detected data indicative of developer images detected in the detection signal produced by the detection unit, thereby reducing the processing time required for the adjustment of the detected data.

According to at least one embodiment of the present invention, a computation formula for computing an adjustment amount of the detected data in response to an input variable representing the difference in the peak positions is prepared in advance, and is used to adjust the detected data indicative of developer images detected in the detection signal produced by the detection unit, thereby reducing the memory volume necessary for storing the above-described correspondence table.

According to at least one embodiment of the present invention, the correspondence table is obtained based on an assumption that the specular reflection component and diffuse reflection component of the detection signal each have a normal distribution. With this arrangement, the correspondence table can easily be made.

According to at least one embodiment of the present invention, the computation formula is a linear function, which can reduce the processing time required for the adjustment of detected data.

According to at least one embodiment of the present invention, a range into which the difference in the peak positions falls is divided into a plurality of sections, and the computation formula is comprised of a linear function defined separately for each of the sections. With this arrangement, the processing time required for the adjustment of detected data can be reduced while avoiding a drop in the accuracy of adjustment amounts.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, embodiments in which the present invention is applied to an image forming apparatus comprised of a tandem-type color laser beam printer will be described with reference to the accompanying drawings. It should be noted that an image forming apparatus to which the present invention is applicable is not limited to a color laser beam printer, and that the present invention is applicable to a wide variety of image forming apparatuses using electrostatic printing, such as color copiers and facsimile machines.

Figure 1:
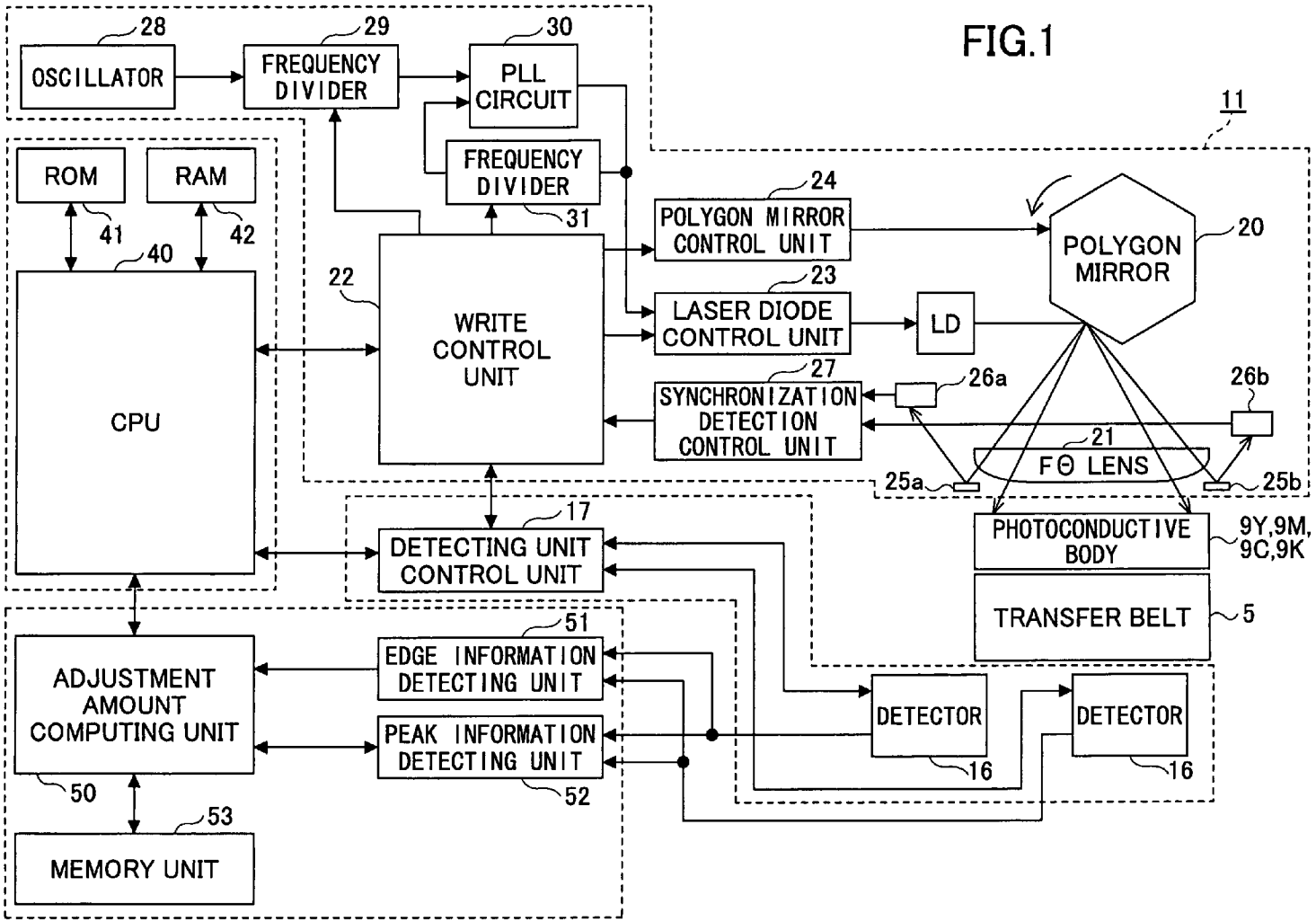
FIG. 1 is a block diagram showing an embodiment of an image forming apparatus according to the present invention.
Figure 7:
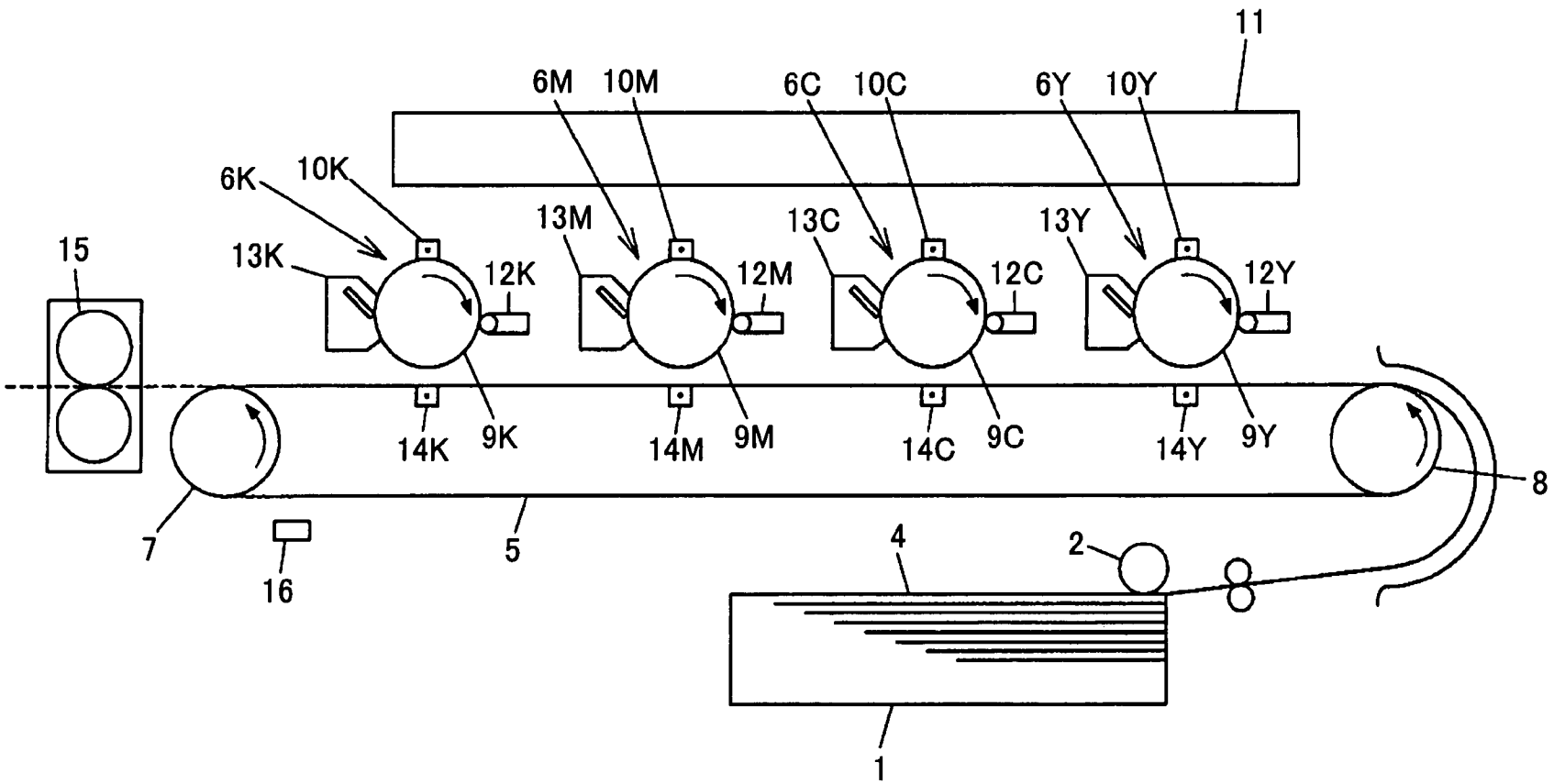
FIG. 7 is a drawing showing the configuration of a main part of the image forming apparatus.

FIG. 7 is a schematic diagram showing a main part of an image forming apparatus according to one embodiment of the present invention. FIG. 1 is a block diagram of the main part shown in FIG. 7.

In FIGS. 1 and 7, first through fourth image process units 6Y, 6C, 6M, and 6K for forming images (toner images) corresponding to respective colors (i.e., Y: yellow, C: cyan, M: magenta, and K: black) are disposed in line along a transfer belt 5 that carries a transfer paper sheet 4 serving as a transfer body. The transfer belt 5 is suspended between a drive roller 8 rotated by a motor (not shown) and a follower roller 7 rotating in conjunction with the drive roller 8. The transfer belt 5 is driven in the direction shown by arrows illustrated in FIG. 7 according to the rotation of the drive roller 8. A sheet feeder tray 1 in which transfer paper sheets 4 are stacked is placed under the transfer belt 5. The transfer paper sheet 4 placed on the top of the stack of sheets stored in the sheet feeder tray 1 is carried toward the transfer belt 5 by a sheet feeder roller 2 at the time of image forming process. The transfer paper sheet 4 is stuck to the transfer belt 5 through electrostatic adhesion. The stuck transfer paper sheet 4 is moved under the first image process unit 6Y that performs image forming by use of yellow toner. The first through fourth image process unit 6Y, 6C, 6M, and 6K include photoconductive bodies 9Y, 9C, 9M, and 9K which are cylindrical image carrying members, respectively. The first through fourth image process units 6Y, 6C, 6M, and 6K further include charging units 10Y, 10C, 10M, and 10K, a light exposure unit 11, developing units 12Y, 12C, 12M, and 12K, and photoconductive body cleaners 13Y, 13C, 13M, and 13K, all of which are placed close to the photoconductive bodies 9Y, 9C, 9M, and 9K, respectively.

As best shown in FIG. 1, the light exposure unit 11 uses a polygon mirror 20 for reflecting a laser beam emitted by a laser light source LD, and uses an fθ lens 21 to converge the light that is shone on the surface of each of the photoconductive bodies 9Y, 9C, 9M, and 9K. In the light exposure unit 11, the polygon mirror 20 rotates to move the laser beam in an axial direction of each of the photoconductive bodies 9Y, 9C, 9M, and 9K to perform a main scan, and each of the photoconductive bodies 9Y, 9C, 9M, and 9K rotates to perform a sub-scan in a circumferential direction of each of the photoconductive bodies 9Y, 9C, 9M, and 9K.

At the time of forming a color image, color breakdown image signals supplied from a color image scan apparatus or from a printer driver of a personal computer are subjected to color conversion processing performed by a CPU 40 according to the intensity levels of these signals for conversion into color image data for black (K), magenta (M), yellow (Y), and cyan (C). This image data is then supplied to a write control unit 22 of the light exposure unit 11.

Upon the start of Image forming process, the surface of each of the photoconductive bodies 9Y, 9C, 9M, and 9K is electrically charged uniformly by the charging units 10Y, 10C, 10GM, and 10K in the dark. After this, the write control unit 22 causes a laser diode control unit 23 to emit a laser beam from the laser light source LD as modulated according to the image data of respective colors received from the CPU 40. Further, the write control unit 22 causes a polygon mirror control unit 24 to rotate the polygon mirror 20, so that patterns corresponding to the color image data are drawn on the surfaces of the photoconductive bodies 9Y, 9C, 9M, and 9K, thereby creating electrostatic latent images. The scanning by the laser beam by the polygon mirror 20 in the main scan direction and the scanning by the laser beam in the sub-scan direction corresponding to the travel direction of the transfer paper sheet 4 are synchronized with each other. Such synchronization is performed by using light receiving devices 26*a* and 26*b* such as photodiodes to detect the laser beam passing through the fθ lens 21 and reflected by returning mirrors 25*a* and 25*b* and by supplying a synchronizing signal from a synchronization detection control unit 27 to the write control unit 22 based on the outputs of the light receiving devices 26*a* and 26*b*. The light exposure unit 11 further includes an oscillator 28 for generating a reference clock signal, a frequency divider 29 for dividing by L the frequency of the reference clock signal output from the oscillator 28, a PLL (phase locked loop) circuit 30, and a frequency divider 31 for dividing by N the output signal of the PLL circuit 30, all of which constitute a clock generator. In this clock generator, the frequency division settings L and N of the respective frequency dividers 29 and 31 are selected by the write control unit 22, so that the frequency of the reference clock signal is divided by a division ratio N/L for provision to the laser diode control unit 23. With this provision, the write control unit 22 can select the settings of L and N in order to adjust the light emission timing of the laser light source LD as controlled by the laser diode control unit 23.

The electrostatic latent images formed on the photoconductive bodies 9Y, 9C, 9M, and 9K are developed by the developing units 12Y, 12C, 12M, and 12K, respectively, thereby forming the toner images of respective colors. These toner images are successively transferred onto and superimposed on the transfer paper sheet 4 carried by the transfer belt 5 at the transfer positions for the respective colors at which the photoconductive bodies 9Y, 9C, 9M, and 9K oppose transfer units 14Y, 14C, 14M, and 14K, respectively, thereby forming a color image. The transfer paper sheet 4, having the image transferred thereon, is then separated from the transfer belt 5 for provision to a fuser unit 15, by which the color image is fused to the transfer paper sheet 4 prior to ejection to a sheet ejecting unit (not shown). After the transfer of the toner images to the transfer paper sheet 4, remaining toners on the photoconductive bodies 9Y, 9C, 9M, and 9K are removed by the photoconductive body cleaners 13Y, 13C, 13M, and 13K provided for the respective photoconductive bodies 9Y, 9C, 9M, and 9K, thereby preparing for a next image forming process.

Positional alignment for superimposing the toner images of respective colors on the transfer paper sheet 4 is performed by selecting the timing of a start of light exposure by the light exposure unit 11 for the respective colors. As a result, the timing at which the transfer paper sheet 4 supplied from the sheet feeder tray 1 is moved by the transfer belt 5 to the transfer positions for the respective colors coincides with the timing at which the toner images on the photoconductive bodies 9Y, 9C, 9M, and 9K are moved to the respective transfer positions.

However, there is a risk of creating an image in which the toner images of the respective colors are misaligned with each other. Such misalignment occurs when the toner images of the respective colors are not properly superimposed at the correct positions because of error in the distances between the axes of the photoconductive bodies 9Y, 9C, 9M, and 9K, error in the parallel positioning of the photoconductive bodies 9Y, 9C, 9M, and 9K, error in the placement of the optical system such as the returning mirrors, errors in the write timings, etc. Even if initial adjustment is made, such errors may occur due to the replacement and maintenance work of image forming units inclusive of the photoconductive bodies and the developing units and also due to the shipment of the apparatus. Moreover, such errors may exhibit variation with time due to the thermal expansion of mechanisms after forming a plurality of images. Because of these errors, adjustment needs to be performed at short internals.

There are five types of positional misalignment (color misalignment) as shown in the following with respect to the toner images of respective colors resulting from these errors (see Japanese Patent Application Publication No. 11-65208 and Japanese Patent Application Publication No. 2002-244393):

skew;

resist misalignment in the sub-scan direction;

pitch fluctuation in the sub-scan direction;

resist misalignment in the main scan direction; and magnification error in the main scan direction.

Figure 8:
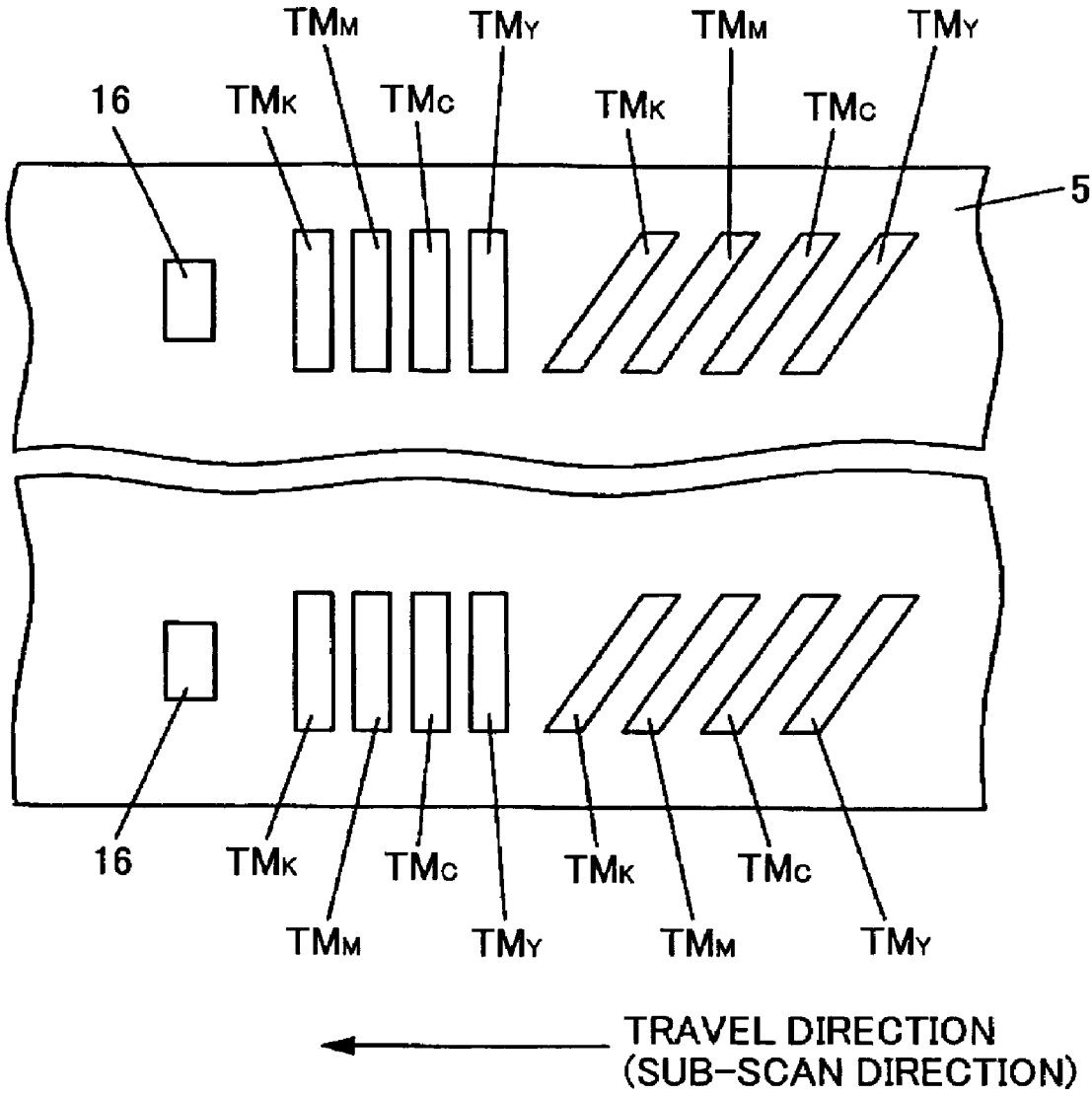
FIG. 8 is a drawing for illustrating correction-purpose toner images.

In consideration of these, the image forming apparatus of the present embodiment performs correction for color positional misalignment prior to the forming of actual color images on the transfer paper sheet 4. In this regard, correction-purpose toner images $TM_Y$, $TM_C$, $TM_M$, and $TM_K$ for the respective colors are created on the transfer belt 5 as shown in FIG. 8, and are detected by using a detecting unit. Then, a positional misalignment correcting unit obtains positional displacements observed between toner images of the respective colors based on the detection results obtained by the detecting unit. Next, the positional misalignment (color misalignment) is corrected by changing the setting of the start time of light exposure by the light exposure unit 11, for example. The detecting unit includes two detectors 16 disposed beneath the transfer belt 5 at opposite ends of a width of the transfer belt 5 in the main scan direction, and further includes a detecting unit control unit 17 for controlling the two detectors 16 (see FIG. 1). The detectors 16 includes a light emitting device comprised of a light emission diode, a light receiving device comprised of a photodiode, and a circuit for amplifying and shaping waveform of the output of the light receiving device. The light emitted by the light emitting device, which is controlled by the detecting unit control unit 17, is reflected by the surface of the transfer belt 5 or by the correction-purpose toner images $TM_Y$, $TM_C$, $TM_M$, and $TM_K$ and then received by the light receiving device. A detection signal having a level responsive to the intensity (light amount) of the reflected light is then supplied from the detectors 16 to a color misalignment correcting unit via an adjustment unit (which includes an adjustment amount computing unit 50, an edge information detecting unit 51, a peak information detecting unit 52, and a memory unit 53).

The detail of the adjustment unit will later be described. The following paragraphs describe the correction of color misalignment performed by the color misalignment correcting unit.

Figure 4A:
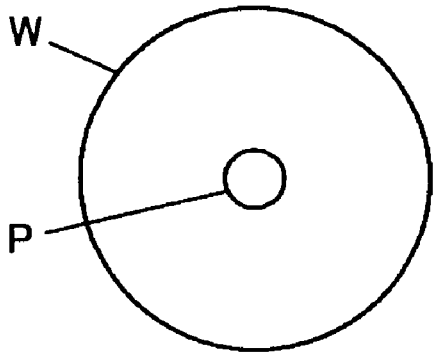
FIGS. 4A and 4B are drawings for explaining spot displacement.
Figure 4B:
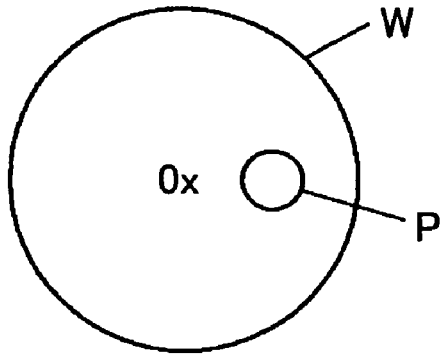

The detectors 16 are placed such that the optical axis of the light emitting device and the optical axis of the light receiving device ideally cross each other on the surface of the transfer belt 5 within a plane parallel to the normal line of the transfer belt 5. The detectors 16 output signals having voltage levels substantially proportional to the amount of light received by the light receiving devices. If the detectors 16 are structured and placed as designed, and the optical axis of the light emitting device and the optical axis of the light receiving device are positioned to satisfy the conditions described above, a specular reflection component P of the reflective light should be received at the center of a light receiving surface W of the light receiving device as shown in FIG. 4A. If the detectors 16 are not structured and placed as designed, and the optical axis of the light emitting device and the optical axis of the light receiving device are not positioned to satisfy the conditions described above, the specular reflection component P of the reflective light is received at a point deviated from the center O of the light receiving surface W, as shown in FIG. 4B.

Further, the reflectance of toner is lower than the reflectance of the surface of the transfer belt 5. As a result, the detection signals output from the detectors 16 have levels decreasing as the proportion of the reflective light reflected by the surface of the transfer belt 5 decreases and the proportion of the reflective light reflected by the toner increases, compared to the situation when the light receiving device receives only the reflective light reflected by the surface of the transfer belt 5.

Figure 3A:
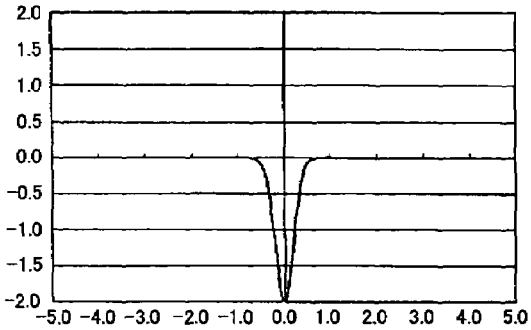
FIGS. 3A through 3F are drawings for illustrating a detection signal.
Figure 3D:
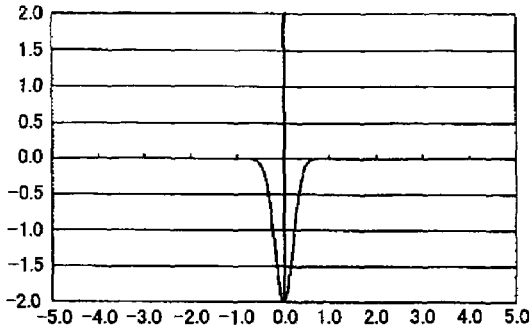
Figure 3B:
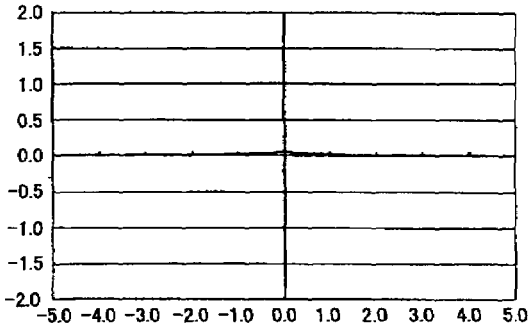
Figure 3E:
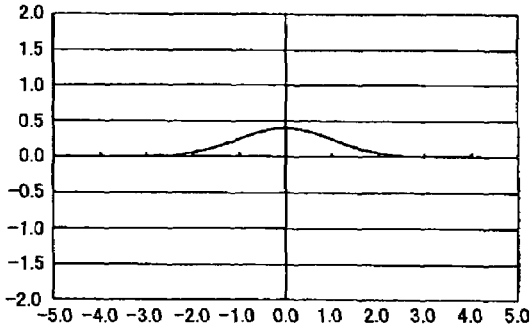
Figure 3C:
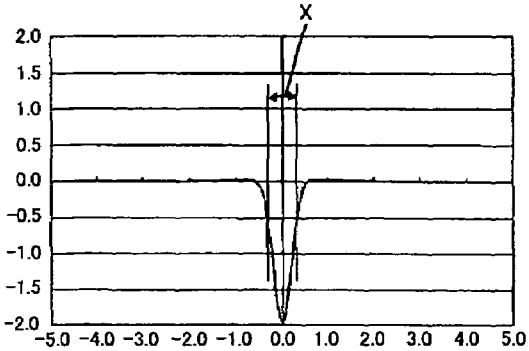
Figure 3F:
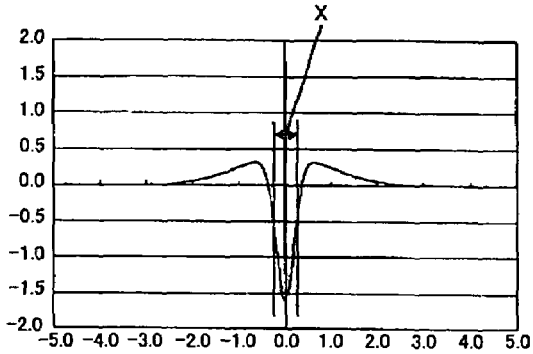

FIGS. 3C and 3F show the waveforms of detection signals. The vertical axis represents the value of the detection signal as normalized by the output level that is observed when only the reflective light from the surface of the transfer belt 5 is received. The horizontal axis represents time as normalized by the time at which the correction-purpose toner images $TM_Y$, $TM_C$, $TM_M$, and $TM_K$ reach the cross point of the optical axes as the transfer belt 5 rotates. FIG. 3A shows the waveform of a detection signal that includes only the specular reflection component of the reflective light reflected by the black correction-purpose toner image $TM_K$.

FIG. 3B shows the waveform of a detection signal that includes only the diffuse reflection component of the reflective light reflected by the black correction-purpose toner image $TM_K$. FIG. 3C shows the waveform of an actual detection signal that includes both the specular reflection component and the diffuse reflection component of the reflective light reflected by the black correction-purpose toner image $TM_K$. The toners (i.e., yellow, magenta, and cyan) other than the black toner have relatively high reflectance. Thus, with respect to the yellow, cyan, and magenta correction-purpose toner images $TM_Y$, $TM_C$, and $TM_M$, the waveform of a detection signal inclusive of only the specular reflection component, the waveform of a detection signal inclusive of only the diffuse reflection component, and the waveform of an actual detection signal inclusive of both components have relatively large absolute values as shown in FIGS. 3D, 3E, and 3F.

The level of the detection signal becomes the lowest when each center of the correction-purpose toner images $TM_Y$, $TM_C$, $TM_M$, and $TM_K$ traveling in the sub-scan direction passes the cross point of the optical axis of the light emitting device and the optical axis of the light receiving device (see FIG. 3C and FIG. 3F). Accordingly, the correction-purpose toner images $TM_Y$, $TM_C$, $TM_M$, and $TM_K$ can be detected by detecting the minus-side peak of the detection signal (i.e., peak in a first area). Specifically, the level of the detection signal is compared with a threshold value (which is −0.5 in an example of FIG. 3C and FIG. 3F) that is set on the minus side, and the center of a section X where the level is below the threshold value (i.e., between the opposite edges of the width of a correction-purpose toner image) is regarded as the minus-side peak of the detection signal (hereinafter referred to as "first peak"), thereby detecting the correction-purpose toner images $TM_Y$, $TM_C$, $TM_M$, and $TM_K$. In this embodiment, the adjustment unit performs the process of detecting the correction-purpose toner images $TM_Y$, $TM_C$, $TM_M$, and $TM_K$. Further, the adjustment unit uses an A/D converter (not shown) to convert the analog output signals of the detectors 16 into digital signals prior to signal processing.

The color misalignment correcting unit includes the CPU 40, a ROM 41 storing a program for correcting color misalignment according to the present invention and programs for other processing, and a RAM 42 for providing a work area necessary for the CPU 40 to execute these programs (see FIG. 1). The CPU 40 executes the program for correcting color misalignment stored in the ROM 41, thereby performing the color misalignment correction of the color misalignment correcting unit.

The CPU 40 obtains positional displacements for the five types of previously described positional misalignments based on the detected values (i.e., time-factor-based data) of the correction-purpose toner images $TM_Y$, $TM_C$, $TM_M$, and $TM_K$ detected by the detectors 16 and the design value of the travel speed of the transfer belt 5. The CPU 40 then performs the following correction so as to remove the obtained positional displacements (see Japanese Patent Application Publication No. 2002-244393). The method of computing positional displacements is disclosed in Japanese Patent Application Publication No. 11-65208, for example, and a detailed description thereof will be omitted.

In the following, the correction of skew will be described. The correction of skew is performed by changing the angle of returning mirrors of the light exposure unit 11 (i.e., the mirrors for directing the laser beam reflected by the polygon mirror 20 to the photoconductive bodies 9Y, 9C, 9M, and 9K: not shown). Such change in the angle of the returning mirrors may be achieved by using a mechanism that can adjust the angle of the returning mirrors by use of a stepping motor (not shown).

The resist misalignment in the sub-scan direction and main scan direction and the pitch fluctuation in the sub-scan direction can be corrected by the CPU 40 instructing the write control unit 22 to advance or delay the timing (write timing) at which the laser diode control unit 23 causes the laser light source LD to output laser light with respect to the synchronizing signal output from the synchronization detection control unit 27 in response to these positional displacements.

The magnification error in the main scan direction can be corrected by the CPU 40 instructing the write control unit 22 to adjust the clock signal output from the clock generator of the light exposure unit 11 in response to the magnification error displacement.

In the following, the adjustment unit according to the present invention will be described. FIGS. 5A through 5C and FIGS. 5D through 5F show the waveform of a detection signal with respect to the black correction-purpose toner image $TM_K$ and the non-black correction-purpose toner images $TM_Y$, $TM_C$, and $TM_M$, respectively, in the same manner as FIGS. 3A through 3F show waveforms. The vertical axis represents the value of the detection signal as having the reference level (=0) when only the reflective light from the surface of the transfer belt 5 is received. The horizontal axis represents time as normalized by the time at which the correction-purpose toner images $TM_Y$, $TM_C$, $TM_M$, and $TM_K$ reach the cross point of the optical axes as the transfer belt 5 rotates.

Figure 5A:
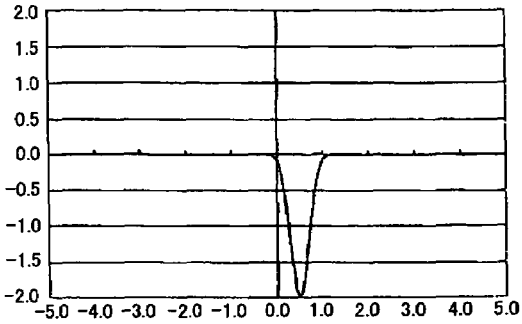
FIGS. 5A through 5F are drawings for illustrating a detection signal.
Figure 5D:
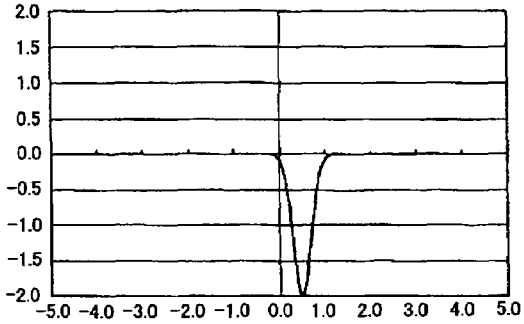
Figure 5B:
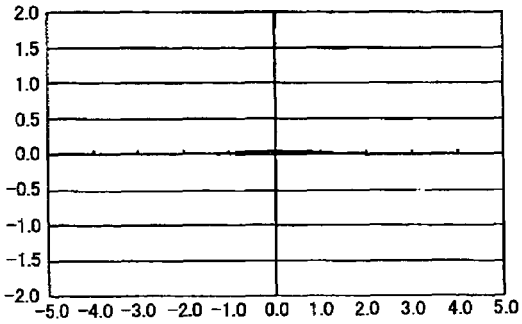
Figure 5E:
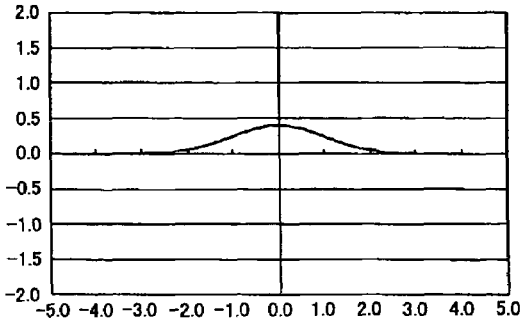
Figure 5C:
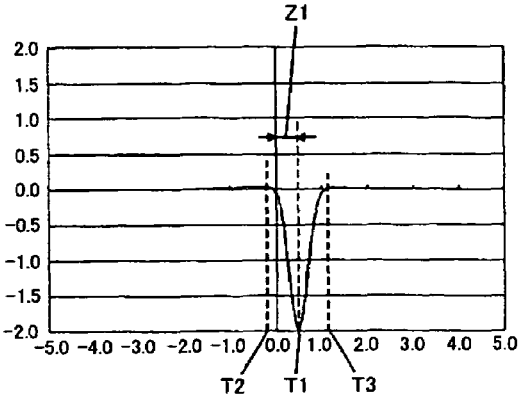
Figure 5F:
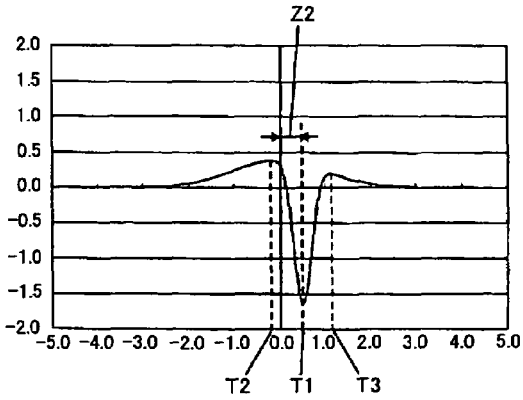

As previously described, the detectors 16 of this embodiment include a light emitting device and a light receiving device, such that the light receiving device receives the light emitted from the light emitting device as reflected by the correction-purpose toner images $TM_Y$, $TM_C$, $TM_M$, and $TM_K$, thereby detecting the correction-purpose toner images $TM_Y$, $TM_C$, $TM_M$, and $TM_K$ by discriminating each minus-side peak (i.e., first peak). If the detectors 16 are not structured and placed as designed due to product variation or the like, so that the optical axis of the light emitting device and the optical axis of the light receiving device are displaced, the point at which the specular reflection component P is received may deviate from the center O of the light receiving surface W as shown in FIG. 4B, which will hereinafter be referred to as a spot displacement. When such spot displacement occurs, the first peak of the detection signal ends up being displaced (delayed) as shown in FIG. 5C and FIG. 5F from the correct timing at which the first peak should really be detected (such correct timing corresponds to the origin of the horizontal axis).

For the purpose of analysis, consideration is now given to a situation in which the reflective light received by the light receiving device is divided into the specular reflection component and the diffuse reflection component. As shown in FIGS. 5A and 5D, the minus-side peak of the specular reflection component is significantly displaced in the horizontal axis (i.e., time axis) as a result of the effect of the spot displacement. As shown in FIGS. 5B and 5E, however, a plus-side peak (i.e., a peak in a second area) of the diffuse reflection component is hardly displaced in the horizontal axis (i.e., time axis), without being affected by the spot displacement. As a result, the displacement of the first peak caused by the spot displacement varies depending on the magnitude of the diffuse reflection component with respect to an actual detection signal in which both the specular reflection component and the diffuse reflection component are present. If such displacement is identical with respect to all the correction-purpose toner images $TM_Y$, $TM_C$, $TM_M$, and $TM_K$, the correction of color misalignment works properly. In reality, however, the diffuse reflection component varies between the correction-purpose toner images $TM_Y$, $TM_C$, $TM_M$, and $TM_K$, so that the displacement also varies, thereby resulting in a problem with the color misalignment correction.

As can be seen from comparison between FIG. 5B and FIG. 5E, the diffuse reflection components of the non-black toners are larger than the diffuse reflection component of the black toner because the reflectance of the black toner is much lower than the reflectance of the non-black toners (i.e., yellow, cyan, and magenta). As a result, there is a significant difference between a displacement Z1 of the first peak of the black correction-purpose toner image $TM_K$ and a displacement Z2 of the first peak of the non-black correction-purpose toner images $TM_Y$, $TM_C$, and $TM_M$ (see FIG. 5C and FIG. 5F).

In the correction of positional misalignment previously described, the positional displacement is obtained based on a relative difference (i.e., temporal difference) between the detection timing of a reference correction-purpose toner image (i.e., the black correction-purpose toner image $TM_K$ in this embodiment) and the detection timing of other correction-purpose toner images (the yellow, cyan, and magenta correction-purpose toner images $TM_Y$, $TM_C$, and $TM_M$ in this embodiment). If a difference develops between the displacement of the first peak of the black correction-purpose toner image $TM_K$ serving as a reference and the displacement of the first peak of the non-black correction-purpose toner images $TM_Y$, $TM_C$, and $TM_M$, and also if a difference develops between the first peaks of the non-black correction-purpose toner images $TM_Y$, $TM_C$, and $TM_M$, the above-noted temporal difference for use in deriving a positional displacement may contain error. As a result, the accuracy of correction of positional misalignment decreases if a positional displacement is derived based on the error-included temporal difference and used for correction.

Figure 6A:
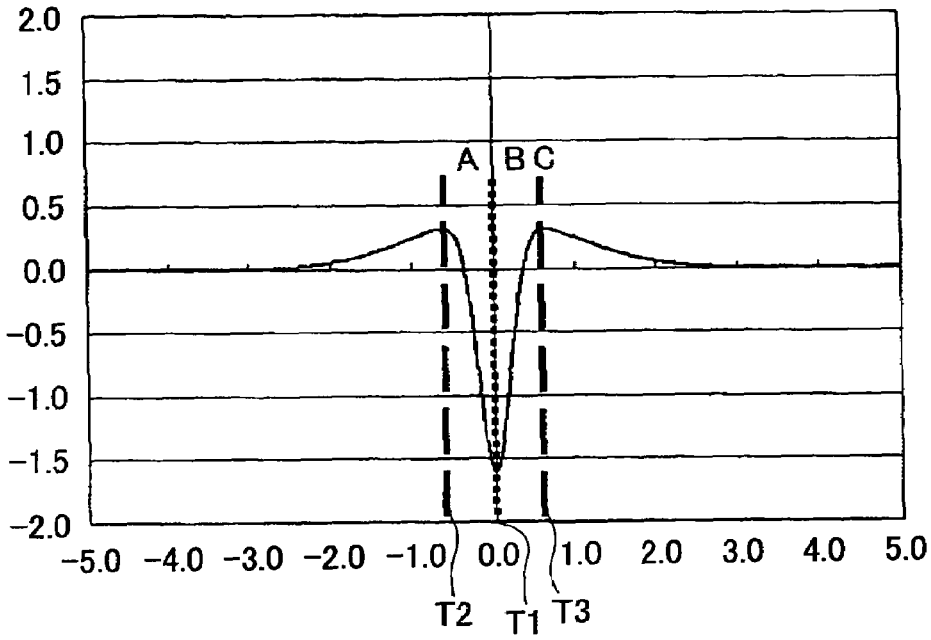
FIGS. 6A and 6B are drawings for explaining spot displacement with respect to the detection signal.
Figure 6B:
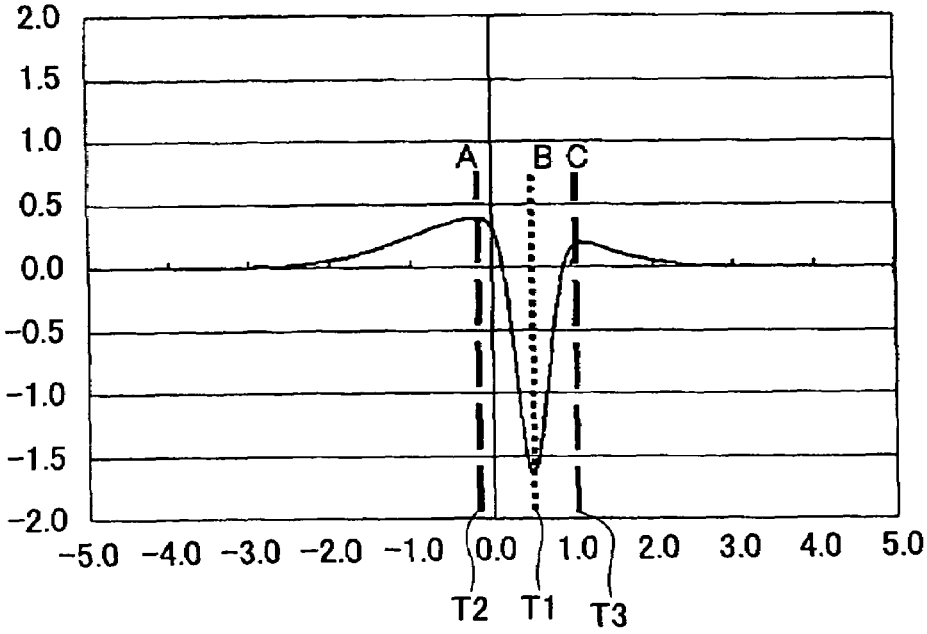

It should be noted that the specular reflection component reflected by the toner surface is lower than the signal level (i.e. reference level=0) as observed when no correction-purpose toner images are detected. On the other hand, the diffuse reflection component reflected by the toner surface is higher than this reference level. Accordingly, the actual detection signal inclusive of these two components has two peaks (i.e., second peak A and third peak C) before and after the minus-side first peak B (see FIGS. 6A and 6B).

As previously described, the spot displacement has almost no effect on the diffuse reflection component. Because of this, a shift of the minus-side peak of the specular reflection component in the temporal axis (i.e., horizontal axis) causes the displacement of the first peak B of the actual detection signal to change according to the amount of the shift. A difference D ($D=|2T1-T2-T3|$) between a first difference ($T1-T2$) existing between the value of the first peak B (i.e., time T1) and the value of the second peak A (i.e., time T2) on the horizontal axis (time axis) of FIG. 6B and a second difference ($T3-T1$) existing between the value of the first peak B (i.e., time T1) and the value of the third peak C (i.e., time T3) can be used to derive the displacement of the spot because there is a correlation between the difference D and the displacement of the spot. Further, there is also a correlation between the displacement of the spot and the error of the detection signal (i.e., temporal error existing in the detection timing), so that this error can be obtained based on the displacement of the spot. Accordingly, the detection timing of the correction-purpose toner images TMY, TMC, TMM, and TMK of the respective colors can be adjusted by the determined error amount. With such an arrangement, the spot displacement does not affect the computation of color displacements for use in the correction of color misalignment, which prevents a drop in the accuracy of the correction of positional misalignment.

Figure 2A:
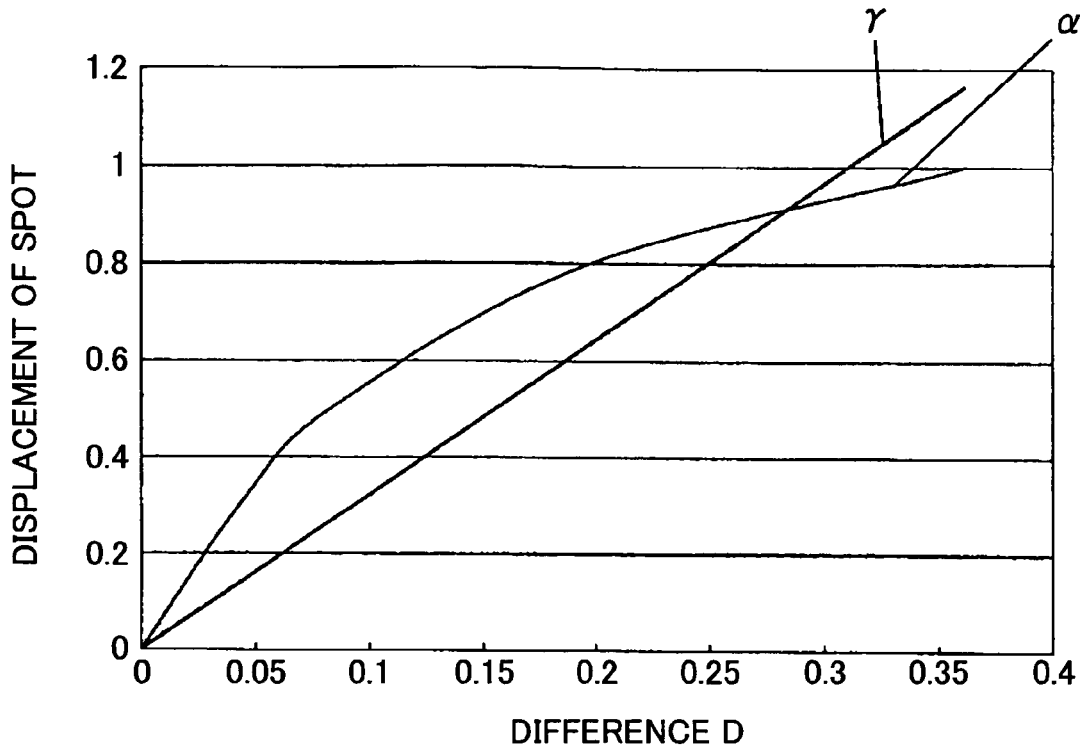
FIG. 2A is a drawing showing the relationship between a spot displacement and a derived difference.

A correlation between the difference D and the displacement of the spot may be determined by assuming that the specular reflection component and diffuse reflection component of the detected output have a normal distribution. The correlation obtained in such manner may be represented as in Table 1 shown in the following or by a characteristic curve α shown in FIG. 2A.

TABLE 1

| T1-T2 | T3-T1 | Difference D | Displacement of Spot |
|---|---|---|---|
| 0.634 | 0.634 | 0 | 0 |
| 0.665 | 0.622 | 0.043 | 0.3 |
| 0.703 | 0.620 | 0.083 | 0.5 |
| 0.827 | 0.630 | 0.197 | 0.8 |
| 1.005 | 0.643 | 0.362 | 1.0 |

Figure 2B:
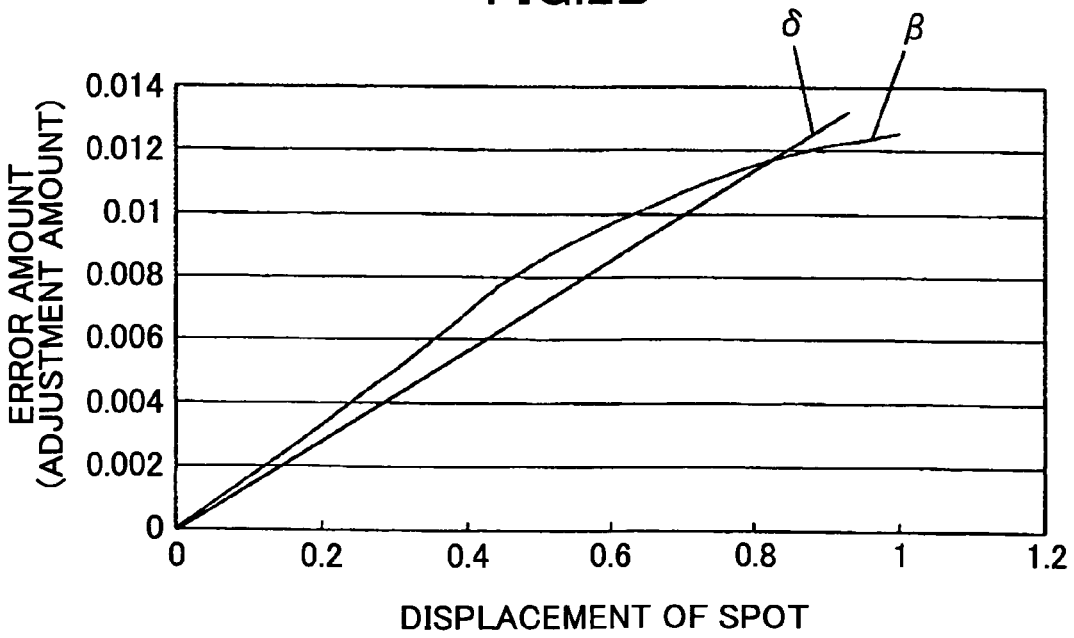
FIG. 2B is a drawing showing the relationship between a spot displacement and an error amount.

Further, correlation between the displacement of the spot and the above-noted error amount is obtained as shown in the following table or as represented by a characteristic curve β shown in FIG. 2B.

TABLE 2

| Displacement of Spot | Error Amount (Adjustment Amount) |
|---|---|
| 0 | 0 |
| 0.3 | 0.0050 |
| 0.5 | 0.0085 |
| 0.8 | 0.0115 |
| 1.0 | 0.0125 |

In this embodiment, the error amount is computed from the difference D by using the two correlations described above. The adjustment unit is provided to adjust the outputs of the detectors 16 to eliminate this error amount. The adjustment unit includes the adjustment amount computing unit 50, the edge information detecting unit 51, the peak information detecting unit 52, and the memory unit 53 as shown in FIG. 1. The edge information detecting unit 51 performs A/D conversion with respect to the detection signals of the detectors 16 for comparison with a predetermined threshold value (which is set to a level lower than the reference level observed when only the reflective light reflected from the surface of the transfer belt 5 is received). The edge information detecting unit 51 then supplies the outcomes of the comparison to the adjustment amount computing unit 50. The peak information detecting unit 52 performs A/D conversion with respect to the detection signals of the detectors 16, and obtains the value of the second peak A (i.e. time T2) and the value of the third peak C (i.e., time T3) at which the detection signals assume a local maximum value exceeding the above-noted reference level. These values are then supplied to the adjustment amount computing unit 50. The adjustment amount computing unit 50 computes, based on the outcomes of the comparison supplied from the edge information detecting unit 51, the value (i.e., time T1) of the center position (i.e., the first peak B on the minus side of the detection signal) of a section X corresponding to the range below the threshold value. The adjustment amount computing unit 50 further computes a first difference between the value T2 of the second peak A and the value T1 of the first peak B and a second difference between the value T3 of the third peak C and the value T1 of the first peak B. The adjustment amount computing unit 50 also computes the difference D between the first difference and the second difference. The correspondence table that lists the values of the difference D and adjustment amounts associated therewith, as obtained based on the correlation shown in TABLE 1 and FIG. 2A and the correlation shown in TABLE 2 and FIG. 2B, is prepared in advance and stored in the memory unit 53. The adjustment amount computing unit 50 refers to the correspondence table stored in the memory unit 53 to obtain the adjustment amount corresponding to the computed difference D for provision to the CPU 40.

The CPU 40 of the color misalignment correction unit adjusts the detection results (i.e., detection timings) of the correction-purpose toner images $TM_Y$, $TM_C$, $TM_M$, and $TM_K$ of the respective colors by using the adjustment amount supplied from the adjustment amount computing unit 50, and computes color displacements based on the adjusted detection results.

In the present embodiment described above, the adjustment unit adjusts the detection results of the correction-purpose toner images $TM_Y$, $TM_C$, $TM_M$, and $TM_K$ detected by the detectors 16. With this arrangement, each of the detectors 16 has only one light receiving device to achieve an inexpensive configuration, yet allows the correction-purpose toner images $TM_Y$, $TM_C$, $TM_M$, and $TM_K$ to be accurately detected. Further, there is no decrease in the accuracy of color misalignment correction performed by the color misalignment correction unit.

Figure 9:
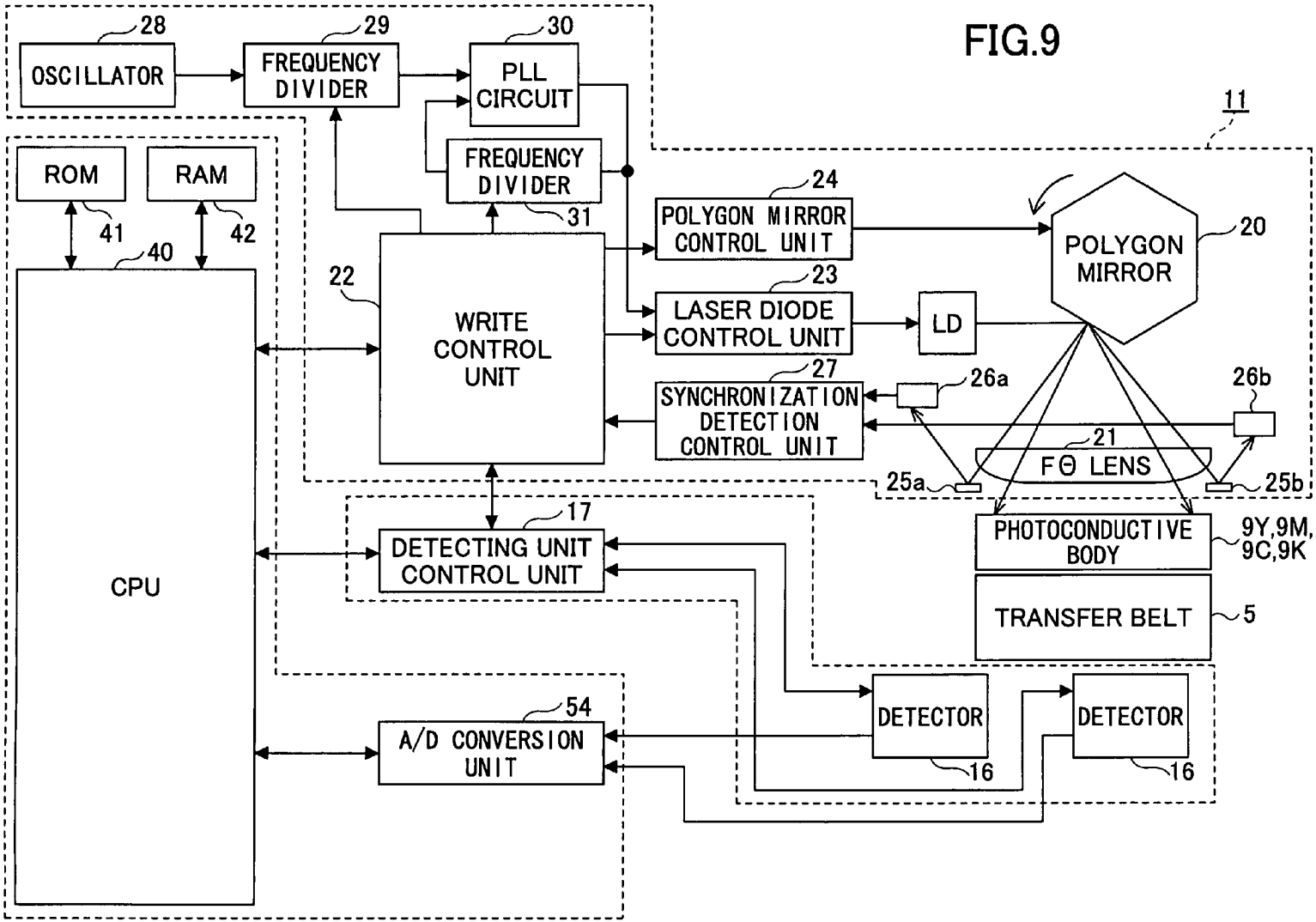
FIG. 9 is a block diagram showing another embodiment of an image forming apparatus according to the present invention.

In this embodiment, the adjustment unit is configured to include the adjustment amount computing unit 50, the edge information detecting unit 51, the peak information detecting unit 52, and the memory unit 53. Alternatively, the adjustment unit may be configured as shown in FIG. 9 to include an A/D conversion unit 54 for performing A/D conversion with respect to the detection signals of the detectors 16 and the color misalignment correction unit inclusive of the CPU 40, the ROM 41, and the RAM 42, such that the CPU 40 executes programs for performing the processes that are performed by the adjustment amount computing unit 50, the edge information detecting unit 51, and the peak information detecting unit 52. This arrangement has an advantage in that cost reduction is achieved through the simplified circuit configuration.

In the present embodiment, the correspondence table prepared in advance and stored in the memory unit 53 is referred to in order to obtain an adjustment amount (error amount). Alternatively, the correlations may be approximated by use of linear functions as represented by a straight line γ shown in FIG. 2A and a straight line δ shown in FIG. 2B, thereby reducing the processing time required for the adjustment of detection results. Moreover, a plurality of dividing sections may be provided with respect to the displacement of the spot, and the above-noted computation formula may be approximated by use of a linear function separately for each of these sections. This arrangement can reduce an accuracy drop in the adjustment amount, as compared to the situation when a single linear function is used for approximation for all these sections, while reducing the processing time required for the adjustment of the detection results.

The present embodiment has been described with reference to an image forming apparatus that directly transfers toner images from the image process unit 6 to the transfer paper sheet 4. This is not intended to be a limiting example. As is known in the art, all the toner images may first be transferred to an intermediate transfer belt, and may then be transferred from the intermediate transfer belt to a transfer paper sheet. The present invention is equally applicable to such an image forming apparatus.

Further, the present invention is not limited to these embodiments, but various variations and modifications may be made without departing from the scope of the present invention.

The present application is based on Japanese priority application No. 2007-014869 filed on Jan. 25, 2007, with the Japanese Patent Office, the entire contents of which are hereby incorporated by reference.

What is claimed is:

1. An image forming apparatus, comprising:

a plurality of image carrying members arranged in line along a travel direction of a transfer body;

an exposure unit configured to expose to light the image carrying members that are electrically charged so as to form electrostatic latent images;

a plurality of developing units configured to develop the electrostatic latent images by use of developers corresponding to respective colors for the respective image carrying members;

a carrying unit configured to carry the transfer body;

a transfer unit configured to transfer the developers of the respective colors from the image carrying members to the transfer body to form developer images on the transfer body;

a detection unit including a light emitting device and a light receiving device, wherein the detection unit is configured to cause the light emitting device to emit light, to cause the light receiving device to receive the light reflected by an object, and to produce a detection signal having a varying signal level responsive to an intensity of the received reflected light, thereby detecting the developer images of respective colors formed on the transfer body by the exposure unit, the developing units, and the transfer unit;

a color misalignment correction unit configured to correct color misalignment resulting from positional misalignment between the developer images of respective colors transferred onto the transfer body by controlling the exposure unit in response to detected data indicative of the developer images detected in the detection signal produced by the detection unit; and an adjustment unit configured to identify a plurality of peak positions in the detection signal corresponding to a single detection of a single line serving as a single developer image and to adjust the detected data indicative of the developer images detected in the detection signal in response to differences in the peak positions, said plurality of peak positions in the detection signal including a position of a negative peak and two positions of positive peaks.

2. The image forming apparatus as claimed in claim 1, wherein the detected data indicative of the developer images detected in the detection signal includes information indicative of edge positions of the developer images.

3. The image forming apparatus as claimed in claim 1, further comprising a memory unit configured to store a correspondence table that lists values of the differences and adjustment amounts of the detected data associated with each other, wherein the adjustment unit is configured to adjust the detected data by referring to the correspondence table.

4. The image forming apparatus as claimed in claim 3, wherein the correspondence table is obtained based on an assumption that each of a specular reflection component and a diffuse reflection component of the detection signal has a normal distribution.

5. The image forming apparatus as claimed in claim 1, wherein the adjustment unit is configured to adjust the detected data by use of a computation formula that provides an adjustment amount of the detected data in response to an input variable representing the difference in the peak positions.

6. The image forming apparatus as claimed in claim 5, wherein the computation formula is a linear function.

7. An image forming apparatus, comprising:

a plurality of image carrying members arranged in line along a travel direction of a transfer body;

an exposure unit configured to expose to light the image carrying members that are electrically charged so as to form electrostatic latent images;

a plurality of developing units configured to develop the electrostatic latent images by use of developers corresponding to respective colors for the respective image carrying members;

a carrying unit configured to carry the transfer body;

a transfer unit configured to transfer the developers of the respective colors from the image carrying members to the transfer body to form developer images on the transfer body;

a detection unit including a light emitting device and a light receiving device, wherein the detection unit is configured to cause the light emitting device to emit light, to cause the light receiving device to receive the light reflected by an object, and to produce a detection signal having a varying signal level responsive to an intensity of the received reflected light, thereby detecting the developer images of respective colors formed on the transfer body by the exposure unit, the developing units, and the transfer unit;

a color misalignment correction unit configured to correct color misalignment resulting from positional misalignment between the developer images of respective colors transferred onto the transfer body by controlling the exposure unit in response to detected data indicative of the developer images detected in the detection signal produced by the detection unit; and an adjustment unit configured to identify a plurality of peak positions in the detection signal detected with respect to a single developer image and to adjust the detected data indicative of the developer images detected in the detection signal in response to differences in the peak positions, wherein the adjustment unit is configured to adjust the detected data by use of a computation formula that provides an adjustment amount of the detected data in response to an input variable representing the difference in the peak positions, wherein the computation formula is a linear function, and wherein a range into which the difference in the peak positions falls is divided into a plurality of sections, and the computation formula is comprised of a linear function defined separately for each of the sections.

8. An image forming apparatus, comprising:

a plurality of image carrying members arranged in a line along a travel direction of a transfer body;

an exposure unit configured to expose to light the image carrying members that are electrically charged in order to form electrostatic latent images;

a plurality of developing units configured to develop the electrostatic latent images by use of developers corresponding to respective colors for the respective image carrying members;

a carrying unit configured to carry the transfer body;

a transfer unit configured to transfer the developers of the respective colors from the image carrying members to the transfer body to form developer images on the transfer body;

a detection unit including a light emitting device and a light receiving device, wherein the detection unit is configured to cause the light emitting device to emit light, to cause the light receiving device to receive the light reflected by an object, and to produce a detection signal having a varying signal level responsive to an intensity of the received reflected light, thereby detecting the developer images of respective colors formed on the transfer body by the exposure unit, the developing units, and the transfer unit; and an adjustment unit configured to identify a first peak of the detection signal positioned in a first area of the detection signal situated on one side of a reference level that is a signal level of the detection signal observed when no developer image is detected, to identify a second peak and third peak of the detection signal that are positioned before and after the first peak on a time axis and that are positioned in a second area of the detection signal situated on an opposite side of the reference level, and to adjust the detected data indicative of the developer images detected in the detection signal in response to a difference between a first distance from the first peak to the second peak and a second distance from the first peak to the third peak.

9. The image forming apparatus as claimed in claim 8, wherein the detected data indicative of the developer images detected in the detection signal includes information indicative of edge positions of the developer images.

10. The image forming apparatus as claimed in claim 8, further comprising a memory unit configured to store a correspondence table that lists values of the difference and adjustment amounts of the detected data associated with each other, wherein the adjustment unit is configured to adjust the detected data by referring to the correspondence table.

11. The image forming apparatus as claimed in claim 10, wherein the correspondence table is obtained based on an assumption that each of a specular reflection component and a diffuse reflection component of the detection signal has a normal distribution.

12. The image forming apparatus as claimed in claim 8, wherein the adjustment unit is configured to adjust the detected data by use of a computation formula that provides an adjustment amount of the detected data in response to an input variable representing the difference in the peak positions.

13. The image forming apparatus as claimed in claim 12, wherein the computation formula is a linear function.

14. The image forming apparatus as claimed in claim 13, wherein a range into which the difference in the peak positions falls is divided into a plurality of sections, and the computation formula is comprised of a linear function defined separately for each of the sections.

* * * * *